US005738058A

United States Patent [19]

Gotto

[11] Patent Number: 5,738,058

[45] Date of Patent: Apr. 14, 1998

[54] DEVICE FOR INHIBITING THE THEFT OF PULL-START INTERNAL COMBUSTION ENGINES

[75] Inventor: Raymond Gotto, Tyreso, Sweden

[73] Assignees: Ray Gotto, Javea; Victor James Wyatt, Moraira, both of Spain

[21] Appl. No.: 617,745

[22] PCT Filed: Jul. 29, 1994

[86] PCT No.: PCT/SE94/00716

§ 371 Date: Aug. 27, 1996

§ 102(e) Date: Aug. 27, 1996

[87] PCT Pub. No.: WO95/14859

PCT Pub. Date: Jun. 1, 1995

[30] Foreign Application Priority Data

Nov. 24, 1993 [SE] Sweden ..... 9303890

[51] Int. Cl.[6] ..... F02P 1/00

[52] U.S. Cl. ..... 123/146.5 B

[58] Field of Search ..... 123/146.5 B, 198 B, 123/198 DC, 185.2, 185.3, 185.14; 307/10.1–10.3; 70/252, 254, 255

[56] References Cited

U.S. PATENT DOCUMENTS

| | | | |
|---|---|---|---|
| 1,857,654 | 5/1932 | Mylar | 123/146.5 B |
| 2,010,984 | 8/1935 | Fitzgerald | 123/146.5 B |
| 2,254,007 | 8/1941 | Fletcher | 123/146.5 B |
| 2,647,937 | 8/1953 | Baumann | 123/146.5 B |
| 3,306,277 | 2/1967 | Gudmundsen | 123/185.14 |
| 3,861,374 | 1/1975 | Dooley et al. | 123/185.14 |
| 4,019,490 | 4/1977 | Reese | 123/146.5 B |
| 4,159,015 | 6/1979 | Gotto et al. | 123/146.5 B |
| 4,909,199 | 3/1990 | Kurozu et al. | 123/146.5 B |
| 5,113,815 | 5/1992 | Ikeda | 123/146.5 B |

*Primary Examiner*—Raymond A. Nelli

*Attorney, Agent, or Firm*—Cowan, Liebowitz & Latman, P.C.

[57] ABSTRACT

A device for preventing the theft of pull-start internal combustion engine devices comprising a key-lock plug integrated into the hand-grip.

6 Claims, 1 Drawing Sheet

A
10
11
12
12'
13
14
15
16
17
18
19
20
21
22
23
24
25
26
27

DEVICE FOR INHIBITING THE THEFT OF PULL-START INTERNAL COMBUSTION ENGINES

The present invention relates to a device for inhibiting the theft of internal combustion engines, for instance outboard engines, lawn mower engines, chain-saw engines, and like engines of the kind in which one end of a pull-cord is wound firmly around a rotatable magnet on the engine, or motor, and the other end of the cord is attached to a handle, wherein a pull on the cord causes the magnet to rotate and therewith generate an ignition spark in a spark plug or plugs.

Outboard motors are often theft-attractive objects and are often mounted on the boat solely by means of a manually manipulatable attachment. This applies in particular to engines of up to 30 HP. it is a simple matter to detach engines of this kind from the boat to which they are fitted and install the engine on another boat. All that is required is to connect the engine fuel feed to a fuel tank. The theft of such engines can be prevented by bolting the engine securely to the boat, which will normally prevent the theft of the engine itself. However, in cases such as these it is not unusual for theboat to be stolen together with the engine attached. However, the theft of a boat and its engine, or motor, also requires the engine fuel feed to be connected to a fuel tank, in peace and quiet, i.e. while undisturbed. Thefts of this nature may be either planned or spontaneous, with the object of selling the engine/boat.

The inventor and other Applicants have come to the conclusion that there is a need for a device which will at least inhibit unlawful activities in this regard, irrespective of the underlying purpose, and particularly, but not exclusively, the theft of boat engines.

The object of the invention is not only to inhibit the actual theft, but also to cause such damage to a stolen engine as to make it difficult to sell the engine, for instance, should the theft-inhibiting device be successfully overcome. Spontaneous thefts that are carried out for the "sake of fun" can be prevented more effectively, however.

The inventor also realizes that it must be possible to retail a theft-inhibiting device of this kind at a reasonable price, in order for the device to gain popularity with potential customers.

These and other objects are achieved with a device of the kind defined in the introduction and having the characteristic features set forth in the characterizing clause of the following main claim.

The invention will now be described in more detail with reference to an exemplifying embodiment of an inventive theft-inhibiting device and also with reference to the accompanying drawing, in which FIG. 1 is a longitudinal section view of an inventive device;

Figures 1, 2, 3:
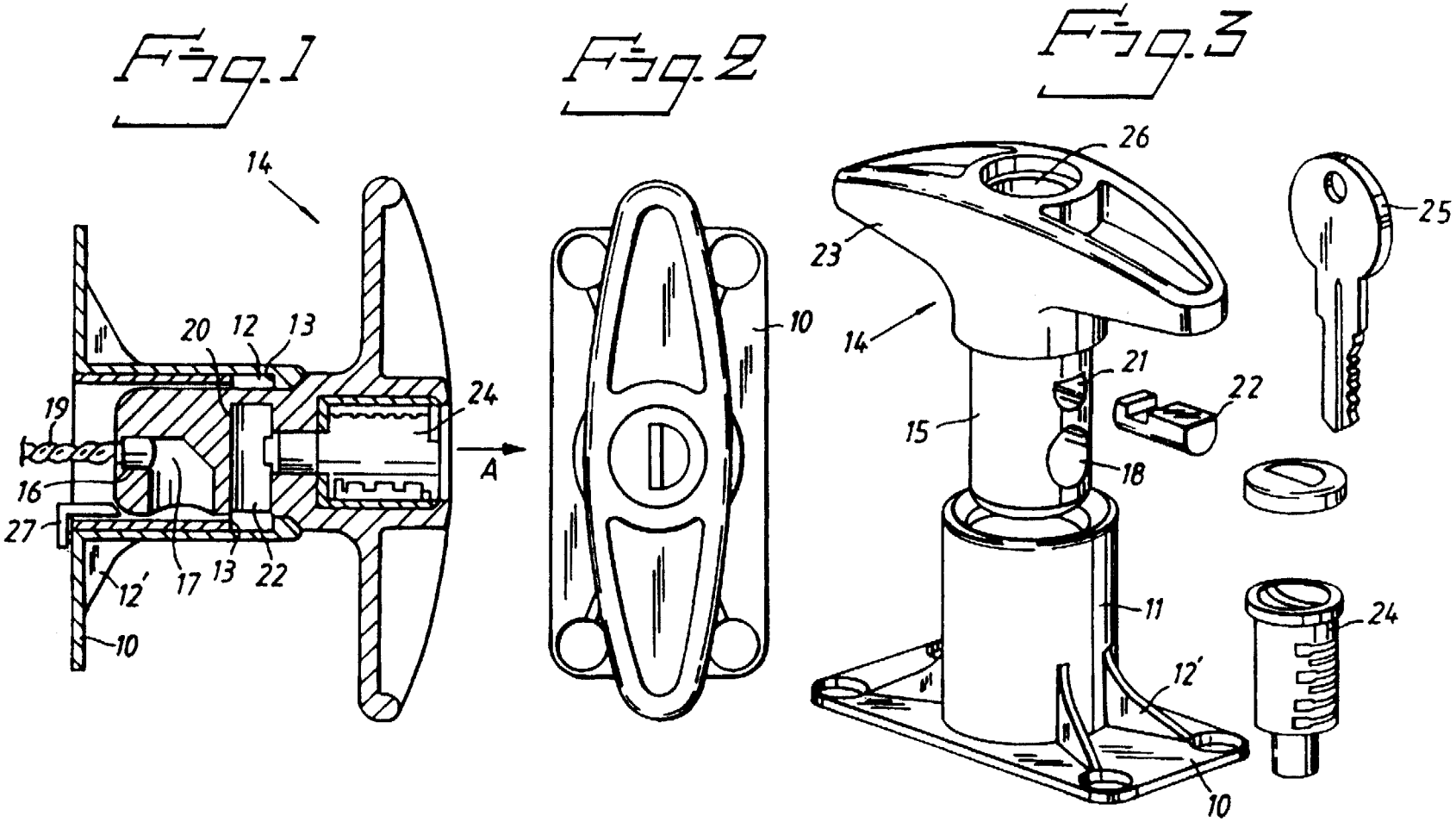
FIG. 2 is a front view of the device shown in FIG. 1.
FIG. 3 illustrates the components of an inventive device.

The theft-inhibiting device is intended for use with internal combustion engines, not shown. More particularly, but not exclusively, the device is intended for use with engines that are started with the aid of a pull-cord whose one end is attached to a rotatable magnet means fitted to the engine. This technique is well known and will not be described or illustrated here.

An outboard engine, or motor, is always provided with an engine casing and an attachment plate 10 may be firmly mounted on one side of the engine casing (not shown). The mounting plate 10 includes a sleeve-like member 11 which is welded firmly to the mounting plate 10 and supported by strengthening means 12'. The mounting plate and the sleeve-like member 11 connected thereto may be firmly mounted on the engine casing in a manner not shown. The end of the sleeve 11 distal from the mounting plate 10 has formed therein a circular groove 12. Alternatively, this end of the sleeve 11 may be collared. In the former case, the opposing vertical walls 13 of the groove 12 each form an abutment or defining surface. Only one forward abutment or defining surface is formed in the latter case.

The reference numeral 14 identifies generally a handgrip which includes a cylindrical body 15 which is received loosely in the sleeve 11. One end of the cylindrical body 15 is provided with a small or relatively small opening 16 which opens into a larger space 17, this space being accessible from outside said member through an opening 18. As shown in FIG. 1, a pull-cord 19 is firmly connected to the body 15, and the space 17 and the opening 18 have been provided so as to enable the pull-cord 19 to be connected in the manner illustrated. The end of the cord 19 located in the small opening 16 may conveniently be thickened so as to lie firmly in said opening.

The body 15 also includes a vertical bore 20 which opens at a distance from the opening 18 (at 21 in FIG. 3). This bore 20 has a semi-circular cross-sectional shape and functions to receive a locking member 22. The manner in which the locking member 22 works and the purpose of said member will be described further on.

The handgrip 14 includes a forward part 23 which is connected to the body 15, preferably integrally therewith, and which is located outside the sleeve 11 and intended to be handled by the operator. The handgrip-part 23 includes a lock plug 24 of conventional basic construction, the pin tumblers of which can be activated with the aid of a conventional key 25.

The lock plug 24 is inserted through an opening 26 in the grip-part 23 and extends towards the pull-cord 19. The free end, or inwardly pointing end of the lock plug 24, coacts with the locking device 22 which is rotatable together with the lock plug.

The inventive device functions in the following manner:

In one state of the device, the locking device 22, which can be moved transversely to the longitudinal axis of the body 15, is generally flush with the surface of said body (see FIG. 1). When the grip-part 23 is pulled in the direction of the arrow A, the device will function normally to start the engine. When the key 25 is inserted into the lock arrangement and turned through about 180°, subsequent rotation of the lock plug will cause the locking device 22 to enter the circular recess 12 and prevent pulling of the handgrip-part 14.

As a further safeguard against unauthorized activity, the inventive device may be provided with a microswitch 27 so that when the engine starting arrangement is locked in the afore-described way, the microswitch will break the electric circuit to earth and therewith stop the supply of current to the coil or magnet on the outboard engine. The current connection is re-established when the locking device 22 is in a passive state.

It will be obvious to the person skilled in this art that the locking device 22 can be formed in different ways, one essential feature being that the locking device can be activated by turning the key 25.

I claim:

1. A device for use with internal combustion engines which are started with the aid of a pull-cord having first and second ends where the first end is wound onto and connected to a rotatable magnet on the engine and the second end is firmly attached to a handgrip, wherein a pull on the handgrip will cause the magnet to rotate and therewith generate an ignition spark in the spark plug or spark plugs, characterized by a cylindrical body (15) which is connected to the handgrip (14) and guided for movement in a tubular guide (11); a key-operated lock plug (24) mounted within the handgrip (14); and a locking member (22) which cooperates with the lock plug (24), wherein rotation of the lock plug (24) entrains the locking member (22) and moves said device from a first position in which the handgrip (14) can be pulled out to a second position in which the handgrip (14) is prevented from being pulled out, or vice versa.

2. A device according to claim 1, characterized in that the cylindrical body (15) is connected to a handgrip-part (23) of the handgrip (14) and includes a bore (20) which extends transversely to the longitudinal axis of the cylindrical body (15), wherein the locking member (22) is mounted in the bore (20) such that turning of the key (25) will result in limited vertical movement of the locking member (22).

3. A device according to claim 2, characterized in that the body (15) has an internal side surface which in the region lying proximal to the handgrip part (23) includes a recess (13) in which the locking member (22) engages.

4. A device according to claim 3, characterized in that the recess (13) is circular.

5. A device according to claim 3, characterized in that the locking member (22) is spring-biased.

6. A device according to claim 1, 2, 3, 4, or 5, characterized by a microswitch (27) which in the active locking position of the locking member (22) functions to break the electric circuit to earth and therewith break the supply of electric current to the coil or magnet.

* * * * *